US010343273B2

(12) United States Patent
Johnson et al.

(10) Patent No.: US 10,343,273 B2
(45) **Date of Patent: *Jul. 9, 2019**

(54) DUAL PURPOSE FLIP-OUT AND T HANDLE

(71) Applicant: WAGIC, INC., Los Gatos, CA (US)

(72) Inventors: Ronald L. Johnson, San Jose, CA (US); Yugen Patrick Lockhart, Palo Alto, CA (US)

(73) Assignee: Wagic, Inc., San Jose, CA (US)

( * ) Notice: Subject to any disclaimer, the term of this patent is extended or adjusted under 35 U.S.C. 154(b) by 126 days.

This patent is subject to a terminal disclaimer.

(21) Appl. No.: 15/588,850

(22) Filed: May 8, 2017

(65) Prior Publication Data

US 2017/0239806 A1 Aug. 24, 2017

Related U.S. Application Data

(63) Continuation of application No. 14/094,117, filed on Dec. 2, 2013, now Pat. No. 9,676,083, which is a continuation of application No. 12/573,719, filed on Oct. 5, 2009, now Pat. No. 8,621,963.

(51) Int. Cl.

| | |
|---|---|
| ***B25G 1/06*** | (2006.01) |
| ***B25B 13/46*** | (2006.01) |
| ***B25B 23/16*** | (2006.01) |
| ***B25G 3/38*** | (2006.01) |

(52) U.S. Cl.

CPC ..... *B25G 1/063* (2013.01); *B25B 13/461* (2013.01); *B25B 23/16* (2013.01); *B25G 3/38* (2013.01); *Y10T 29/49826* (2015.01)

(58) Field of Classification Search

CPC ..... B25B 23/16; B25G 3/38

USPC ..... 81/177.6

See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | Lafogre |
| 647,528 | A | 4/1900 | Schmidt |
| 655,007 | A | 7/1900 | Rairigh |
| 696,995 | A | 4/1902 | Moser |
| 763,745 | A | 6/1904 | Gheen |
| 776,761 | A | 12/1904 | Sampson |
| 873,363 | A | 12/1907 | Ross |
| 875,493 | A | 12/1907 | Beard |
| 890,150 | A | 6/1908 | Marble |
| 959,408 | A | 5/1910 | Volbert |

(Continued)

FOREIGN PATENT DOCUMENTS

| | | |
|---|---|---|
| CA | 1147176 | 5/1983 |
| CA | 1232781 A | 2/1988 |

(Continued)

*Primary Examiner* — Hadi Shakeri

(74) *Attorney, Agent, or Firm* — Haverstock & Owens LLP

(57) ABSTRACT

A dual purpose flip-out and T handle ratchet is able to be used in an L or modified L-handle orientation as well as a T handle orientation. The dual purpose flip-out and T handle includes a handle portion and a ratchet head and neck portion. The handle portion is coupled to the neck portion at a lockable hinge. The hinge allows the head and neck portion to rotate to an L or modified L-handle orientation or to a T handle orientation. When properly oriented the tool is able to be used to tighten or loosen objects such as screws or bolts.

18 Claims, 9 Drawing Sheets

(56) References Cited

U.S. PATENT DOCUMENTS 1,000,900 A 8/1911 Dorsey
1,006,679 A 10/1911 Rice
1,100,070 A 6/1914 Graham
1,172,656 A 2/1916 Yorgensen
1,187,842 A 6/1916 Kaas
D53,597 S 7/1919 Mrcmann
1,398,583 A 11/1921 Bovee
1,425,270 A 8/1922 Morgan
1,500,852 A 7/1924 Shepard
1,502,044 A 7/1924 McCann
1,530,905 A 3/1925 Nance
1,559,097 A 10/1925 Hill
1,699,020 A 1/1929 Raleigh
1,753,026 A 4/1930 Rosati
1,825,936 A 6/1931 Bodmer
1,888,222 A 11/1932 Curtis et al.
1,915,245 A 6/1933 Cook
1,940,606 A 1/1934 Little
1,970,409 A 8/1934 Wiedermann
1,973,188 A 9/1934 Verderber
2,236,333 A 3/1941 Cowies
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartkey
2,465,152 A 3/1949 Ellison
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,636 A 12/1950 Minnich
2,569,069 A 9/1951 Motel
2,590,307 A 3/1952 Gibson
2,593,828 A 4/1952 Arey
2,604,211 A 7/1952 Steine
2,701,052 A 2/1955 Martel
D175,056 S 6/1955 Wilson
2,715,028 A 8/1955 Dossie
2,719,042 A 9/1955 Epsy
2,726,091 A 12/1955 Topar
2,776,589 A 1/1957 Gregory
2,778,396 A 1/1957 Swain
2,786,380 A 3/1957 Rolland
D179,979 S 4/1957 Noga
2,797,599 A 7/1957 McGarvie, Jr.
2,800,816 A 7/1957 Tasciotti
2,804,970 A 9/1957 Kuc et al.
2,810,472 A 10/1957 Midkiff
2,821,403 A 1/1958 Bernard
2,836,210 A 5/1958 Garofalo
2,842,020 A 7/1958 Tranquino
2,844,244 A 7/1958 Hanson
2,851,915 A 9/1958 Martinez
2,854,741 A 10/1958 Cholger
2,878,701 A 3/1959 Weersma
2,977,824 A * 4/1961 Rueb ..... B25B 13/461
29/453
3,023,054 A 2/1962 Shigekuni
3,061,927 A 11/1962 Von Krakenberg
3,113,479 A 12/1963 Swingle
3,156,143 A 11/1964 Wolf
3,222,959 A 12/1965 Clark
3,255,792 A 6/1966 Beck
3,257,991 A 6/1966 Mosch
D205,745 S 9/1966 Namfeldt
3,343,434 A 4/1967 Schroeder
3,342,229 A 9/1967 Janes
3,370,696 A 2/1968 Dembicks
3,424,039 A 1/1969 Scott
3,592,086 A 7/1971 Derwin
3,654,975 A 4/1972 Ballsmith et al.
3,667,518 A 6/1972 Stillwagon, Jr.
3,707,893 A 1/1973 Hofman
3,773,936 A 5/1973 Flynn
3,766,811 A 10/1973 Callahan
3,802,286 A 4/1974 Winklhofer et al.
3,863,693 A 2/1975 Carniker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jameson
4,235,269 A 11/1980 Kraus
4,238,862 A 12/1980 Leatherman
4,241,773 A 12/1980 Personnat
4,302,990 A 12/1981 Chrichton et al.
4,308,770 A 1/1982 MacDonald
4,310,094 A 1/1982 Hotchkiss
4,327,790 A 5/1982 Stevens et al.
4,384,499 A 5/1983 Shockley
D270,024 S 8/1983 Strasser
4,424,728 A 1/1984 MacDonald
4,440,048 A 4/1984 Stevens
4,448,097 A 5/1984 Rocca
4,469,109 A 10/1984 Mehl
4,476,751 A 10/1984 Mishma
4,525,889 A 7/1985 Dunau
4,542,667 A 9/1985 Jang
D284,810 S 7/1986 Kelemen, Sr.
4,598,822 A 7/1986 Hemmings
4,621,718 A 11/1986 Decarolis
4,640,155 A 2/1987 Condon
4,667,822 A 5/1987 Coopmans
4,699,020 A 10/1987 Bush et al.
4,699,030 A 10/1987 Yang
4,703,673 A 11/1987 Allen
4,711,353 A 12/1987 Rozmestor
4,715,346 A 12/1987 Dempsey
4,716,765 A 1/1988 Corona et al.
4,716,796 A 1/1988 Corona et al.
4,767,006 A 11/1988 Wasem
4,783,867 A 11/1988 Tsao
4,787,276 A 11/1988 Condon
4,815,346 A 3/1989 Littlehorn
4,819,523 A 4/1989 Souza
4,819,800 A 4/1989 Wilson
4,820,090 A 4/1989 Chen
D302,102 S 7/1989 Amagaya
4,882,841 A 11/1989 Margolis
4,922,569 A 5/1990 Brinker
4,926,721 A 5/1990 Hsiao
D308,462 S 6/1990 Komatsu
4,934,223 A 6/1990 Wong
D310,770 S 9/1990 Zmarripa
D311,124 S 10/1990 Learney
4,960,016 A 10/1990 Seals
4,974,477 A 12/1990 Anderson
4,979,407 A 12/1990 Hernanadez et al.
5,029,707 A 7/1991 Feng
5,036,975 A 8/1991 Chow
5,042,658 A 8/1991 Tiramani et al.
5,062,173 A 11/1991 Collins et al.
5,063,796 A 11/1991 Gennep
5,065,487 A 11/1991 Yother
5,086,674 A 2/1992 Her
5,146,815 A 9/1992 Scott
5,147,038 A 9/1992 Pergeau
D333,769 S 3/1993 Jureckson
D334,516 S 4/1993 Tsunoda
D339,048 S 9/1993 Baum
5,251,352 A 10/1993 Cullison
5,263,389 A 11/1993 Frazell et al.
5,265,504 A 11/1993 Fruhm
D342,433 S 12/1993 Sorenson
5,271,300 A 12/1993 Zurbuchen et al.

(56) References Cited

U.S. PATENT DOCUMENTS

| | | | |
|---|---|---|---|
| D343,106 | S | 1/1994 | Eklind et al. |
| 5,295,422 | A | 3/1994 | Chow |
| 5,320,004 | A | 6/1994 | Hsiao |
| 5,416,940 | A | 5/1995 | Bandera |
| D359,571 | S | 6/1995 | Acosta |
| 5,421,225 | A | 6/1995 | Chen |
| 5,394,984 | A | 9/1995 | Alba |
| 5,450,774 | A | 9/1995 | Chang |
| 5,461,950 | A | 10/1995 | Iwinski |
| D365,681 | S | 1/1996 | Chow |
| 5,480,166 | A | 1/1996 | Milsop |
| 5,495,942 | A | 3/1996 | Ishak |
| 5,499,560 | A | 3/1996 | Aeschliman |
| 5,499,562 | A | 3/1996 | Feng |
| 5,505,316 | A | 4/1996 | Lee |
| 5,515,969 | A | 5/1996 | Schonenbach |
| 5,517,885 | A | 5/1996 | Feng |
| 5,522,291 | A | 6/1996 | Liu |
| 5,535,882 | A | 7/1996 | Liu |
| 5,542,322 | A | 8/1996 | Knox et al. |
| D373,943 | S | 9/1996 | Fuhrmann |
| 5,553,340 | A | 9/1996 | Brown |
| 5,566,596 | A | 10/1996 | Lin |
| D376,520 | S | 12/1996 | Morin |
| 5,581,834 | A | 12/1996 | Collins |
| D377,444 | S | 1/1997 | Lin |
| 5,592,859 | A | 1/1997 | Johnson et al. |
| D378,797 | S | 4/1997 | Poremba et al. |
| 580,235 | A | 4/1997 | Strum |
| 5,630,342 | A | 5/1997 | Owoc |
| D380,131 | S | 6/1997 | Sung |
| D382,190 | S | 8/1997 | Blackston et al. |
| 5,653,525 | A | 8/1997 | Park |
| D383,048 | S | 9/1997 | Sorenson et al. |
| 5,662,013 | A | 9/1997 | Lin |
| D385,172 | S | 10/1997 | Bramsiepe et al. |
| D386,955 | S | 12/1997 | Jones et al. |
| 5,692,659 | A | 12/1997 | Dembicks |
| D388,609 | S | 1/1998 | Chan |
| 5,711,042 | A | 1/1998 | Chuang |
| 5,711,194 | A | 1/1998 | Anderson et al. |
| D394,792 | S | 6/1998 | Bourque |
| D394,794 | S | 6/1998 | Vasudeva |
| 5,758,870 | A | 6/1998 | Weaver |
| 5,765,247 | A | 6/1998 | Seber et al. |
| 5,765,454 | A | 6/1998 | Barbulescu et al. |
| 5,768,960 | A | 6/1998 | Archuleta |
| 5,791,211 | A | 8/1998 | Bondhus et al. |
| 5,802,936 | A | 9/1998 | Liu |
| 5,803,584 | A | 9/1998 | Chung |
| 5,816,401 | A | 10/1998 | Vasudeva et al. |
| 5,820,288 | A | 10/1998 | Cole |
| 5,822,930 | A | 10/1998 | Lin |
| D400,775 | S | 11/1998 | Hsu |
| 5,855,274 | A | 1/1999 | Piao |
| D405,335 | S | 2/1999 | Lin |
| D408,253 | S | 4/1999 | Rowlay |
| 5,911,799 | A | 6/1999 | Johnson et al. |
| 5,916,277 | A | 6/1999 | Dallas |
| 5,916,341 | A | 6/1999 | Lin |
| 5,918,513 | A | 7/1999 | Ho |
| 5,918,741 | A | 7/1999 | Vasudeva |
| 5,938,028 | A | 8/1999 | Hu |
| 5,970,828 | A | 10/1999 | Bondhus et al. |
| D415,946 | S | 11/1999 | Tsai |
| 5,983,759 | A | 11/1999 | Turner |
| 5,992,625 | A | 11/1999 | Loiselle |
| 5,992,626 | A | 11/1999 | Anderson |
| D418,731 | S | 1/2000 | Rowlay et al. |
| D420,885 | S | 2/2000 | Lin |
| 6,032,332 | A | 3/2000 | Lin |
| 6,032,796 | A | 3/2000 | Hopper et al. |
| 1,337,769 | A | 4/2000 | Hemming |
| 6,044,973 | A | 4/2000 | Vasudeva |
| 6,050,409 | A | 4/2000 | Delbeck |
| D426,449 | S | 6/2000 | Eklind |
| D426,452 | S | 6/2000 | Eklind |
| D427,875 | S | 7/2000 | Chiu |
| 6,085,620 | A | 7/2000 | Anderson et al. |
| 6,088,861 | A | 7/2000 | Session et al. |
| 6,089,133 | A | 7/2000 | Liao |
| 6,092,656 | A | 7/2000 | Ernst |
| 6,095,018 | A | 8/2000 | Schuster |
| 6,105,767 | A | 8/2000 | Vasudeva |
| 6,128,981 | A | 10/2000 | Bondhus et al. |
| 6,131,740 | A | 10/2000 | Huang |
| D433,613 | S | 11/2000 | Jailin |
| D433,910 | S | 11/2000 | Oliver et al. |
| 6,151,998 | A | 11/2000 | Fu-Hui |
| D435,415 | S | 12/2000 | Johnson et al. |
| 6,164,172 | A | 12/2000 | Huang |
| D435,773 | S | 1/2001 | Lin |
| D437,541 | S | 2/2001 | Hermansen et al. |
| D437,763 | S | 2/2001 | Oliver et al. |
| 6,186,785 | B1 | 2/2001 | Rogers et al. |
| 6,202,864 | B1 | 3/2001 | Ernst |
| 6,206,189 | B1 | 3/2001 | Huot, Jr. et al. |
| D440,852 | S | 4/2001 | Ernst |
| 6,209,425 | B1 | 4/2001 | Hu |
| 6,233,769 | B1 | 5/2001 | Seber et al. |
| 6,237,451 | B1 | 5/2001 | Wei |
| 6,257,106 | B1 | 7/2001 | Anderson et al. |
| 6,260,453 | B1 | 7/2001 | Anderson et al. |
| 6,279,434 | B1 | 8/2001 | Brown |
| 6,279,435 | B1 | 8/2001 | Zayat, Jr. |
| 6,289,768 | B1 | 9/2001 | Anderson et al. |
| 6,295,903 | B1 | 10/2001 | Tripper et al. |
| 6,305,248 | B1 | 10/2001 | Rowlay |
| 6,308,599 | B1 | 10/2001 | Fu-Hui |
| 6,311,587 | B1 | 11/2001 | Johnson et al. |
| 6,314,600 | B1 | 11/2001 | Cachot |
| 6,314,838 | B2 | 11/2001 | Wall |
| 6,318,218 | B1 | 11/2001 | Anderson et al. |
| 6,332,381 | B1 | 12/2001 | Vasudeva |
| 6,345,557 | B1 | 2/2002 | Kuo |
| D454,766 | S | 3/2002 | Lin |
| 6,352,010 | B1 | 3/2002 | Giarritta et al. |
| 6,357,068 | B1 | 3/2002 | Seber et al. |
| D455,630 | S | 4/2002 | Chiu |
| 6,371,290 | B1 | 4/2002 | Yearous et al. |
| 6,378,402 | B1 | 4/2002 | Kalomeris et al. |
| 6,382,057 | B1 | 5/2002 | Kienholz |
| 6,389,931 | B1 | 5/2002 | Delaney et al. |
| 6,397,709 | B1 | 6/2002 | Wall |
| 6,401,576 | B1 | 6/2002 | Wu |
| 6,401,923 | B1 | 6/2002 | Huang |
| 6,405,620 | B2 | 6/2002 | Liao |
| D459,967 | S | 7/2002 | Johnson et al. |
| D461,311 | S | 8/2002 | Gharib |
| 6,427,564 | B1 | 8/2002 | Nelson |
| 6,490,954 | B2 | 12/2002 | Johnson et al. |
| 6,510,767 | B1 | 1/2003 | Rivera |
| D470,739 | S | 2/2003 | Chen |
| D472,712 | S | 4/2003 | Sagen |
| D472,931 | S | 4/2003 | Leins |
| 6,564,680 | B1 | 5/2003 | Rinner et al. |
| 6,598,503 | B1 | 7/2003 | Cunningham |
| 6,601,481 | B2 | 8/2003 | Chuang |
| 6,606,925 | B1 | 8/2003 | Gmeilbauer |
| D479,963 | S | 9/2003 | Chang |
| 6,634,502 | B1 | 10/2003 | Yu |
| 6,640,675 | B1 | 11/2003 | Chuang |
| 6,675,678 | B2 | 1/2004 | Liu |
| 6,698,318 | B2 | 3/2004 | Peters |
| 6,701,813 | B2 | 3/2004 | Hu |
| 6,709,196 | B1 | 3/2004 | Medendorp |
| 6,739,224 | B1 | 5/2004 | Wershe |
| 6,751,819 | B2 | 6/2004 | Chuang |
| 6,751,820 | B1 | 6/2004 | Wu |
| 6,752,046 | B1 | 6/2004 | Lee |
| 6,758,350 | B2 | 7/2004 | Lin |
| 6,763,744 | B2 | 7/2004 | Johnson et al. |
| D494,438 | S | 8/2004 | Falkenstein et al. |
| 6,799,490 | B1 | 10/2004 | Chu |

(56) References Cited

U.S. PATENT DOCUMENTS 6,827,210 B2 12/2004 Chen
6,863,471 B2 3/2005 Medendorp
6,877,186 B2 5/2005 Shiao
6,896,136 B2 5/2005 Hu
6,898,998 B2 5/2005 Shyu
6,910,826 B1 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,935,212 B2 8/2005 Wadsworth
6,941,843 B2 9/2005 Johnson et al.
6,948,406 B1 9/2005 Li
6,968,758 B2 11/2005 Lin
6,971,291 B2 12/2005 An
6,988,616 B2 1/2006 Chen
7,028,593 B1 4/2006 Lin et al.
7,047,847 B2 5/2006 Chuang
7,051,626 B1 5/2006 Chen et al.
7,051,629 B2 5/2006 Huang
D523,637 S 6/2006 Chang
7,066,061 B1 6/2006 Chen et al.
7,073,418 B2 7/2006 Kuo
7,080,582 B2 7/2006 Karle
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,155,998 B1 1/2007 Shyu
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,185,565 B1 3/2007 Hu
7,216,569 B2 5/2007 Abdelgany
7,237,463 B1 7/2007 Lee
D548,464 S 8/2007 Lin
7,284,466 B1 10/2007 Ho
7,287,450 B1 10/2007 Liao
D557,099 S 12/2007 Lin
7,305,908 B2 12/2007 Chi
7,406,896 B2 8/2008 Rivera
7,409,894 B1 8/2008 Valentine
7,415,745 B2 8/2008 Rivera
7,467,574 B1 12/2008 Lin
7,467,575 B2 12/2008 Lai
7,565,852 B2 7/2009 Yu
7,571,517 B2 8/2009 Smith et al.
7,600,640 B2 10/2009 Hallee et al.
D604,509 S 11/2009 Andrews
7,698,972 B2 4/2010 Hi
7,743,685 B2 6/2010 Chang
D622,125 S 8/2010 Robinson
D623,037 S 9/2010 Johnson et al.
7,810,415 B2 10/2010 Adamany et al.
7,815,058 B2 10/2010 Cheng
7,836,534 B2 11/2010 Simmons
7,846,203 B2 12/2010 Cribier
7,946,203 B2 5/2011 Johnson et al.
8,011,277 B2 9/2011 Johnson et al.
8,015,642 B1 9/2011 Oakley
D650,257 S 12/2011 Royes et al.
8,336,428 B2 12/2012 Johnson et al.
8,359,954 B2 1/2013 Johnson et al.
8,468,916 B2 6/2013 Johnson et al.
8,613,121 B1 12/2013 White
8,621,963 B2 1/2014 Johnson et al.
8,640,574 B2 2/2014 Johnson et al.
8,757,033 B2 6/2014 Johnson
8,875,601 B2 11/2014 Johnson et al.
8,925,429 B2 1/2015 Johnson
9,144,801 B2 9/2015 Johnson
9,604,349 B2 3/2017 Johnson
2001/0005576 A1 6/2001 Rogers et al.
2001/0012754 A1 8/2001 Anderson
2001/0045145 A1 11/2001 Legg
2003/0000902 A1 1/2003 Keis et al.
2003/0047474 A1 3/2003 Dahlson
2003/0126957 A1 7/2003 Huang
2003/0136234 A1 7/2003 Cunningham
2003/0188610 A1 10/2003 Cluthe
2003/0226428 A1 12/2003 Liu
2004/0050218 A1 3/2004 Napoli
2004/0079622 A1 4/2004 Wang
2004/0173061 A1 9/2004 Liou
2004/0262344 A1 12/2004 White
2005/0011318 A1 1/2005 Tsai
2005/0199108 A1 9/2005 Jheng
2005/0211587 A1 9/2005 Chen
2005/0229752 A1 10/2005 Nickipuck
2005/0245900 A1* 11/2005 Ash ..... A61M 25/0017 604/537
2005/0247587 A1 11/2005 Holland-Letz
2005/0268754 A1 12/2005 Fa
2005/0284267 A1 12/2005 Liao et al.
2006/0042428 A1 3/2006 Chuang
2006/0101955 A1 5/2006 Chang
2006/0118500 A1 6/2006 Chen
2006/0150784 A1 7/2006 Hsieh
2006/0254396 A1 11/2006 Hu
2006/0288531 A1 12/2006 Hu
2006/0288823 A1 12/2006 Schepman
2007/0007222 A1 1/2007 Kao
2007/0023306 A1 2/2007 Lai
2007/0044559 A1 3/2007 Andrews
2007/0044598 A1 3/2007 Frohm et al.
2007/0056117 A1 3/2007 Gardiner et al.
2007/0056872 A1 3/2007 Begim
2007/0062831 A1 3/2007 Chen
2007/0084740 A1 4/2007 Malek
2007/0141885 A1 6/2007 Chen
2007/0151402 A1 7/2007 Scheerman et al.
2007/0186731 A1 8/2007 Schnarr et al.
2007/0221017 A1 9/2007 Heaven
2007/0228672 A1 10/2007 Huang
2007/0235360 A1 10/2007 Lin
2007/0245862 A1 10/2007 Gonzalez et al.
2007/0295171 A1 12/2007 Johnson et al.
2008/0011634 A1 1/2008 Lin
2008/0128370 A1 6/2008 Shih
2008/0148909 A1 6/2008 Lai
2008/0156754 A1 7/2008 Cheng
2008/0164171 A1 7/2008 Meng
2008/0190249 A1 8/2008 Yu
2008/0202963 A1 8/2008 Liao
2008/0223179 A1 9/2008 Nash et al.
2008/0251402 A1 10/2008 Chiu
2008/0256816 A1 10/2008 Consentino
2008/0271573 A1 11/2008 Lown et al.
2008/0295657 A1 12/2008 Culthe
2009/0107303 A1 4/2009 Steinweg et al.
2009/0183604 A1 7/2009 Johnson et al.
2009/0183608 A1 7/2009 Johnson et al.
2009/0183609 A1 7/2009 Johnson et al.
2009/0241740 A1 10/2009 Heagerty
2010/0258465 A1 10/2010 Gomas
2011/0000024 A1 1/2011 Johnson et al.
2011/0094910 A1 4/2011 Fleury et al.
2012/0012485 A1 1/2012 Wang
2013/0112635 A1 5/2013 Tsukaguchi
2013/0228484 A1 9/2013 Yang
2013/0228539 A1 9/2013 Lin
2013/0256168 A1 10/2013 Poillot
2013/0306508 A1 11/2013 Gallegos
2014/0091118 A1 4/2014 Hsiao
2015/0001113 A1 1/2015 Hsiao

(56) References Cited

U.S. PATENT DOCUMENTS

FOREIGN PATENT DOCUMENTS

| | | | |
|---|---|---|---|
| CN | 2628630 | Y | 7/2004 |
| DE | 464002 | | 8/1928 |
| DE | 2035793 | B1 | 3/1972 |
| DE | 2453480 | A | 5/1976 |
| DE | 3744176 | A1 | 8/1989 |
| DE | 102004011892 | | 1/2005 |
| DE | 202004013404 | U1 | 3/2005 |
| DE | 20 2007 003841 | U1 | 9/2007 |
| EP | 856233 | | 12/1960 |
| EP | 503559 | A1 | 9/1992 |
| EP | 618046 | A1 | 10/1994 |
| EP | 1693163 | | 2/2006 |
| EP | 01777042 | | 4/2007 |
| FR | 787512 | | 9/1935 |
| JP | 55045442 | U | 3/1980 |
| JP | 57-13165 | | 1/1982 |
| JP | 61136778 | | 6/1986 |
| JP | 3-47775 | | 5/1991 |
| JP | 03103162 | | 10/1991 |
| JP | 429368 | | 3/1992 |
| JP | 5-31882 | | 4/1993 |
| JP | 0850512 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | | 4/1983 |
| WO | 9412322 | A1 | 6/1994 |
| WO | 199623631 | | 8/1996 |
| WO | 97/29887 | | 8/1997 |

* cited by examiner

DUAL PURPOSE FLIP-OUT AND T HANDLE

This Patent Application is a continuation application of the co-pending U.S. patent application Ser. No. 14/094,117 entitled DUAL PURPOSE FLIP-OUT AND T-HANDLE and filed on Dec. 2, 2013, which is a continuation application of the U.S. patent application Ser. No. 12/573,719 entitled DUAL PURPOSE FLIP-OUT AND T-HANDLE and filed on Oct. 5, 2009. The U.S. patent application Ser. No. 14/094,117 entitled DUAL PURPOSE FLIP-OUT AND T-HANDLE and filed on Dec. 2, 2013 and the U.S. patent application Ser. No. 12/573,719 entitled DUAL PURPOSE FLIP-OUT AND T-HANDLE and filed on Oct. 5, 2009 are both hereby incorporated by reference.

FIELD OF THE INVENTION

The present invention relates to hand tools. More specifically, the present invention relates to a dual purpose tool which is able to flip-out to form an L-handle and also form a T handle ratchet.

BACKGROUND OF THE INVENTION

T handle tools have a T-shaped body, including a long leg member and a short handle member. T handles usually have hexagonal-shaped tips for use with screws and other objects designed to accept a hexagonal tip. Once inserted, rotational pressure is applied to the hexagonal wrench in order to tighten or loosen the screw. The leg member and handle of the hexagonal wrench are designed to be in the shape of the letter "T" so that a user is able to grasp the handle with his hand(s) more comfortably.

T handle tools are manufactured and distributed in multiple English and metric sizes in order to facilitate their use with screw heads of multiple sizes. Such tools are usually sold in a set which includes tools of multiple sizes but are also distributed individually.

When using a T handle tool, a user will insert a leg end of the T handle tool onto the head of a workpiece such as a hexagonal screw, and will then exert rotational pressure using the handle on the handle end of the tool in order to tighten or loosen the screw. Due to the shape of the T handle tool it is particularly difficult to quickly turn a T handle tool because the user must constantly remove and replace his hand on the handle as it turns. Furthermore, the handle is usually not very easy to grip.

While the T handle tool is very helpful, there are instances due to space constrictions, that a T handle orientation is not usable and a modified orientation is needed for a hard to reach screw.

SUMMARY OF THE INVENTION

A dual purpose flip-out and T handle is able to be used in an L or modified L-handle orientation as well as a T handle orientation. The dual purpose flip-out and T handle includes a handle portion and a ratchet head and neck portion. The handle portion is coupled to the neck portion at a lockable hinge. The hinge allows the head and neck portion to rotate to an L or modified L-handle orientation or to a T handle orientation. When properly oriented the tool is able to be used to tighten or loosen objects such as screws or bolts.

In one aspect, a device comprises a first element and a second element with a ratchet mechanism, the second element coupled to the first element at a hinge, wherein the second element is configurable to a plurality of positions by movement around the hinge. The device further comprises a locking mechanism configured for locking the second element into the plurality of positions. The device further comprises an aperture within the first element, the aperture configured for receiving the ratchet mechanism of the second element. The plurality of positions include forming an L handle, a modified-L handle, a T handle and a modified-T handle. The modified-L handle forms an angle greater than 90° and less than 180° between the first element and the second element. The first element is configured to receive the second element when forming the T handle. The first element and the second element comprise rubber, plastic, metal or a combination thereof.

In another aspect, a device comprises a head and neck element including a head and a neck, a handle element including a body, an aperture within the body, the aperture configured for receiving the head and a slot within the body, the slot configured for receiving the neck, a lockable hinge for coupling the head and neck element and the handle element, the lockable hinge configured for allowing the head and neck element to move into a plurality of positions and maintaining a position of the plurality of positions and a ratchet mechanism contained within the head. The ratchet mechanism is removable. The plurality of positions include forming an L handle, a modified-L handle, a T handle and a modified-T handle. The modified-L handle forms an angle greater than 90° and less than 180° between the head and neck element and the handle element. The aperture is configured to receive the head when forming the T handle. The head and neck element and the handle element comprise rubber, plastic, metal or a combination thereof.

In yet another aspect, a method of manufacturing a device comprises forming a first element, forming a second element containing a ratchet mechanism and coupling the first element and the second element with a hinge, the second element configurable to a plurality of positions by movement around the hinge. The first element comprises a body, an aperture within the body, the aperture configured for receiving a head of the second element and a slot within the body, the slot configured for receiving a neck of the second element. The second element comprises a head and a neck. The hinge is lockable. The plurality of positions include forming an L handle, a modified-L handle, a T handle and a modified-T handle. The modified-L handle forms an angle greater than 90° and less than 180° between the first element and the second element. The first element is configured to receive the second element when forming the T handle. The first element and the second element comprise rubber, plastic, metal or a combination thereof.

DETAILED DESCRIPTION

A dual purpose flip-out and T handle enables a user to use the handle in an L or modified-L configuration and also a T or modified-T handle configuration providing a very versatile tool.

Figure 1:
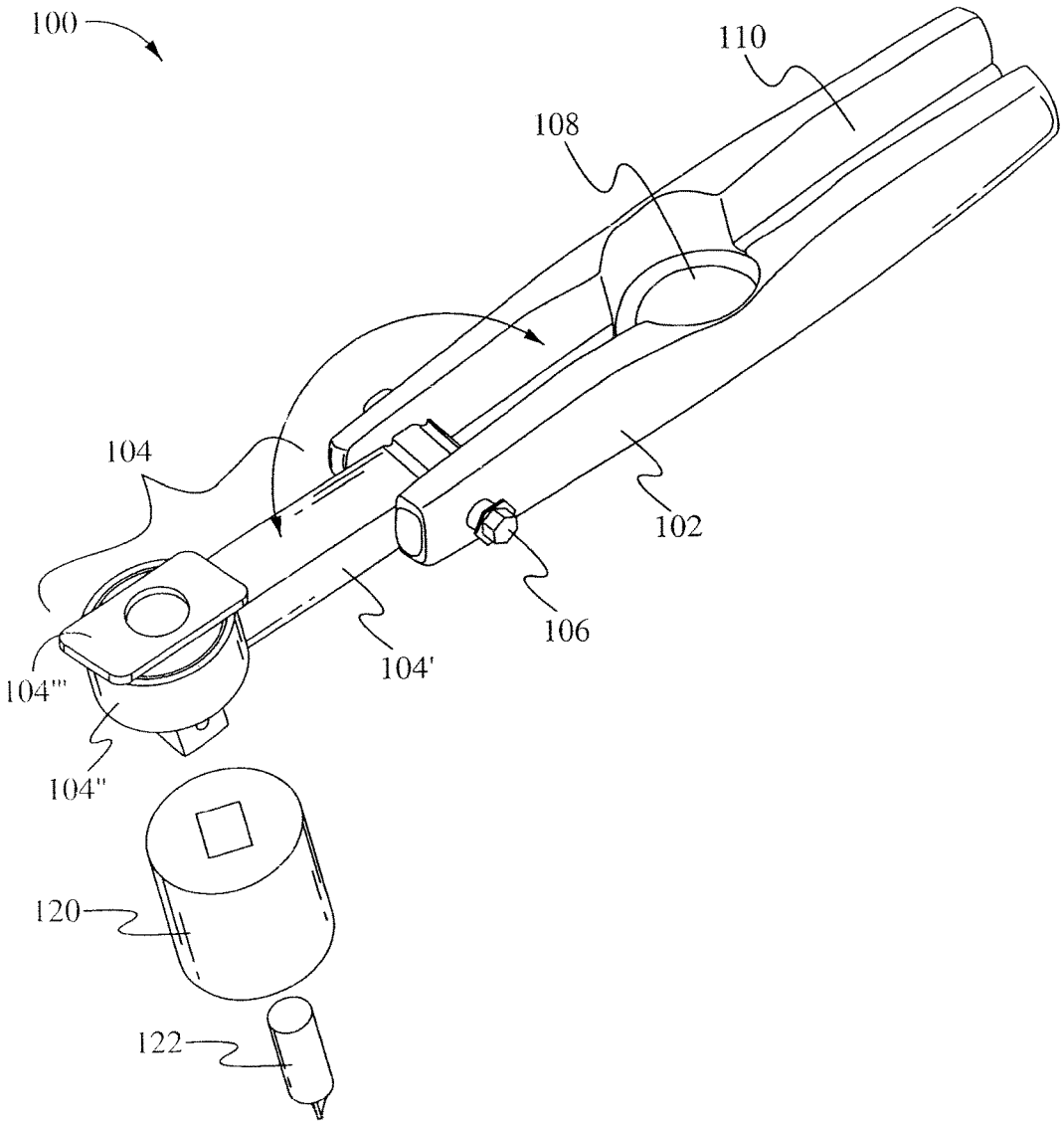
FIG. 1 illustrates a perspective view of a dual purpose flip-out and T handle in accordance with an embodiment of the invention.

FIG. 1 illustrates a perspective view of a dual purpose flip-out and T handle 100. The handle 100 includes a first element 102 also referred to as a handle portion and a second element 104 which includes a stem portion 104' and a head portion 104", the head portion 104" configured for receiving a drive 104'". In some embodiments, the stem portion 104', the head portion 104" and the drive 104'" are a single component, and in some embodiments, they are separate components. The first element 102 and the second element 104 are coupled to each other at a hinge 106. In some embodiments, the hinge 106 includes a locking mechanism. The locking mechanism is able to be any type of locking mechanism. In some embodiments, the first element 102 includes an aperture 108 for receiving the head portion 104" of the second element 104. In some embodiments, the first element 102 includes a slot 110 for receiving the stem portion 104' of the second element 104. The drive 104'" is a ratchet mechanism. A drive 104'" is able to be any size including but not limited to a ¼" drive and a ⅜" drive. In some embodiments, a connector device 120 couples to the drive 104'" which then interfaces with a screw, bolt or other object. In some embodiments, the connector device 120 receives a tool 122 such as a screwdriver head which then interfaces with a screw or other object.

Figure 2:
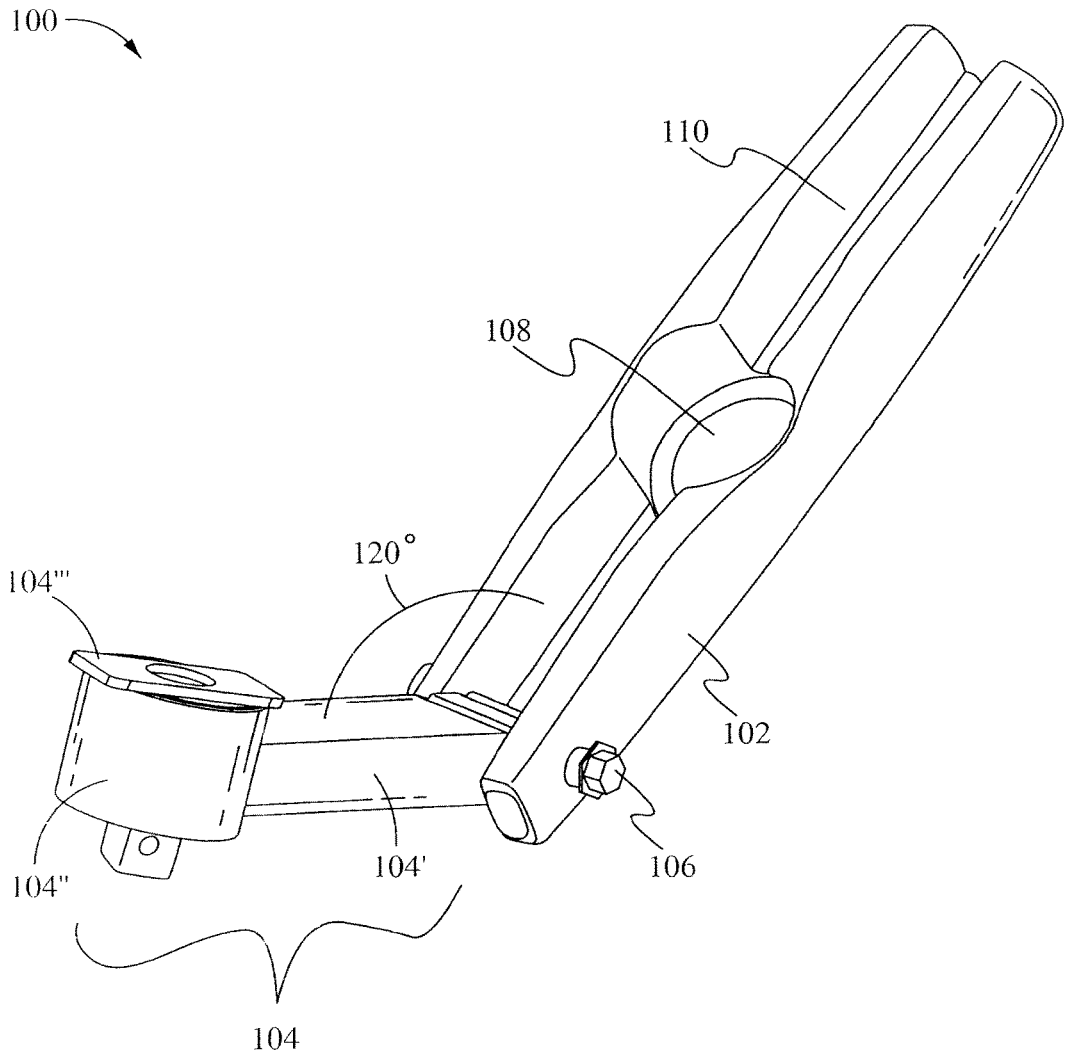
FIG. 2 illustrates a perspective view of the dual purpose flip-out and T handle configured in a modified-L position in accordance with an embodiment of the invention.

FIG. 2 illustrates a perspective view of the dual purpose flip-out and T handle 100 configured in a modified-L position. In an L position, the angle between the first element 102 and the second element 104 is 90°. In the modified L-position, the angle between the first element 102 and the second element 104 is greater than 90° and less than 180°. The handle 100 is able to reach 180° or more, but the closer the angle reaches to 180°, the more the handle 100 appears similar to a straight handle which is at 180°. By changing from a 180° straight handle to an L or modified-L position allows a user to tighten a nut, bolt or other object when a straight handle is not able to perform the task. For example, if a bolt is not easily accessible due to other objects nearby, a straight handle may not be able to reach the bolt; however, when configured appropriately, the handle 100 is able to reach the bolt. In some embodiments, the handle 100 is able to operate when configured at any angle.

Figure 3:
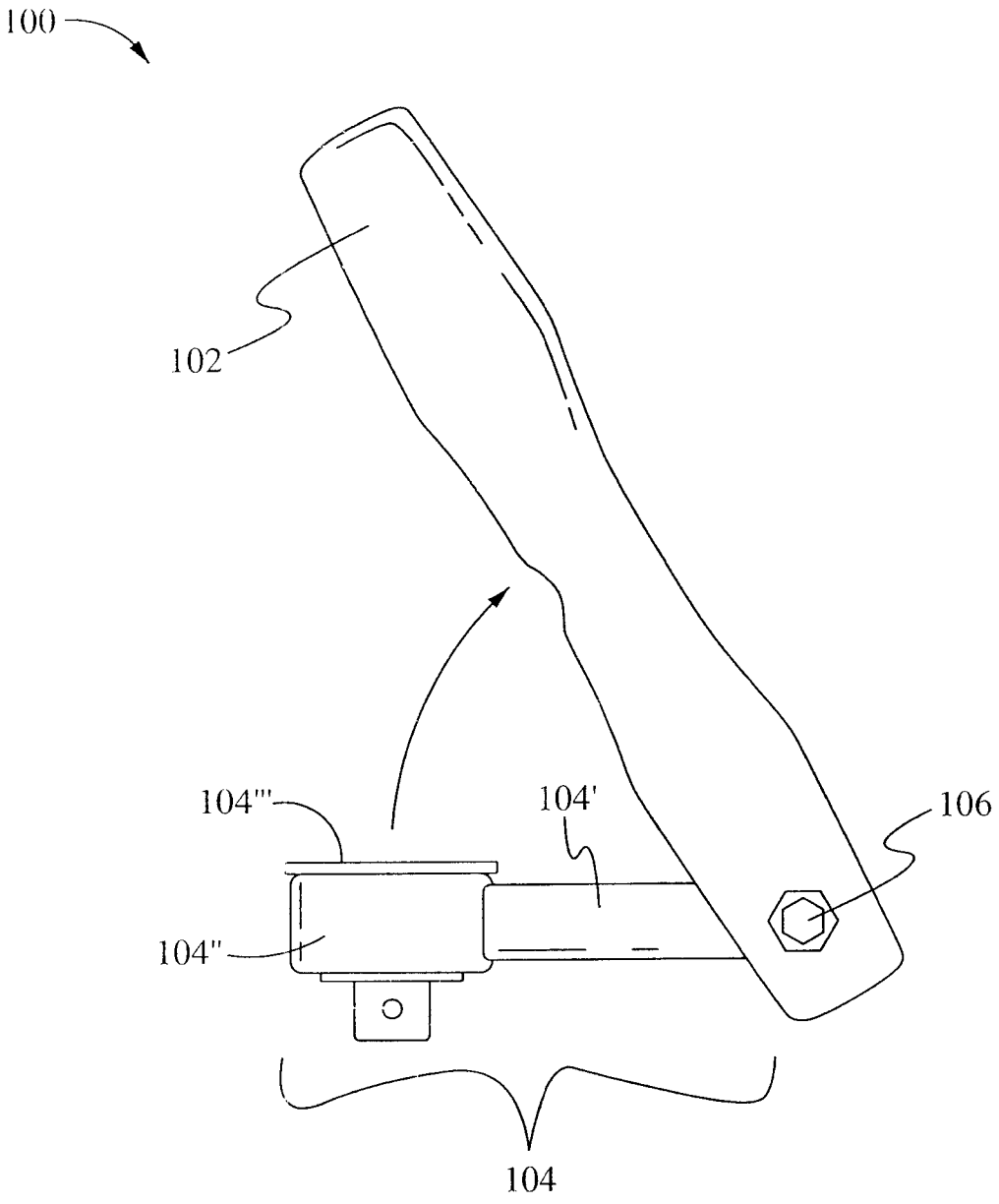
FIG. 3 illustrates a perspective view of the dual purpose flip-out and T handle in the process of being configured in the T position in accordance with an embodiment of the invention.

FIG. 3 illustrates a perspective view of the dual purpose flip-out and T handle 100 in the process of being configured in the T position. By moving (e.g. rotating) the first element 102 towards the second element 104, the handle 100 is able to be configured in a T position. The configuring is able to be performed with one hand.

Figure 4:
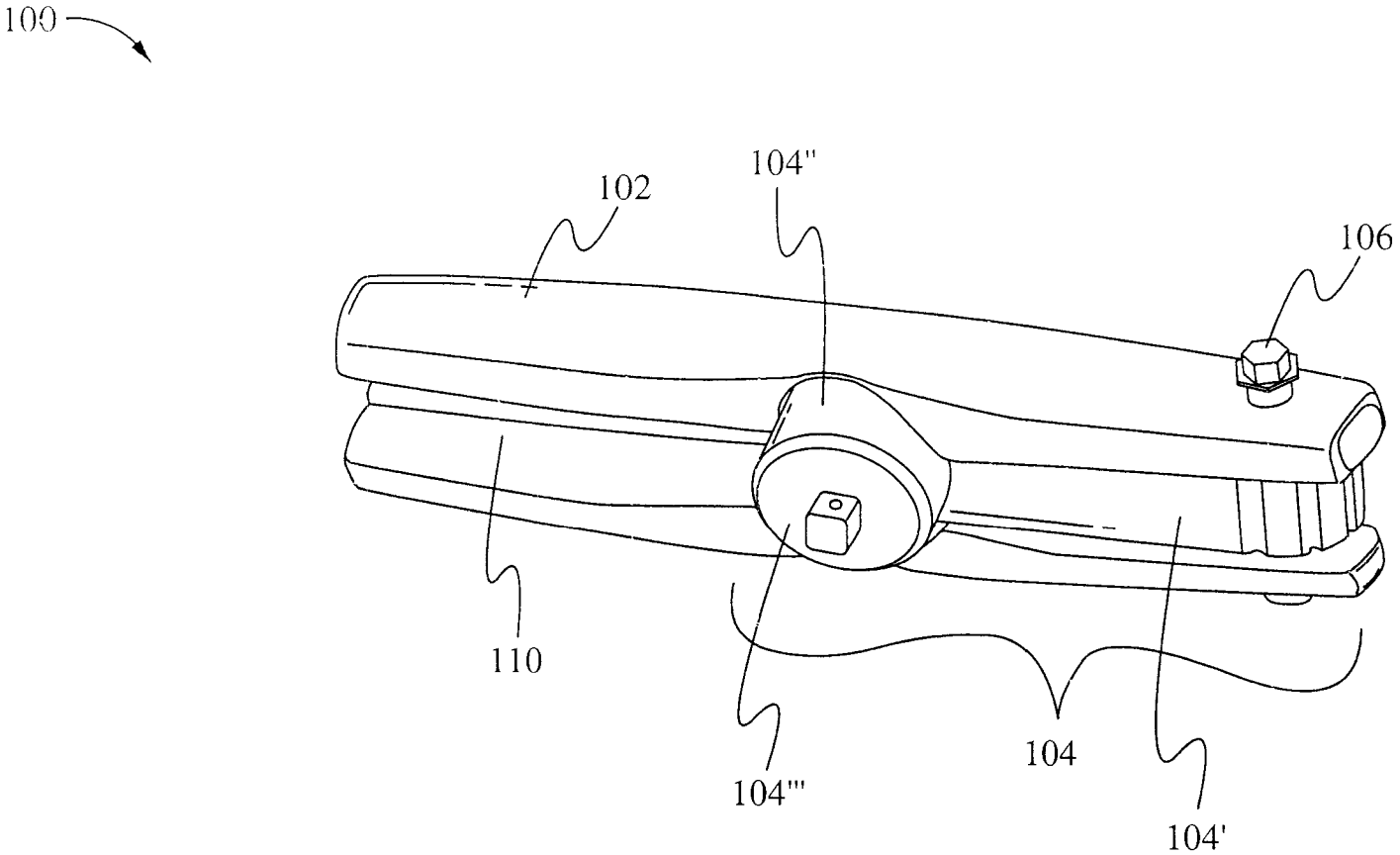
FIG. 4 illustrates a perspective view of the dual purpose flip-out and T handle configured in the T position in accordance with an embodiment of the invention.

FIG. 4 illustrates a perspective view of the dual purpose flip-out and T handle 100 configured in the T position. When in the T position, the second element 104 is positioned within the first element 102. In some embodiments, the head portion 104" of second element 104 is positioned within an aperture 108 of the first element 102, and the stem portion 104' of the second element 104 is positioned within a slot 110 of the first element 102. FIG. 4 illustrates the purpose of the aperture 108, as it allows the user to access the back of the driver 104'" in order to facilitate drive reversal. In some embodiments, the first element 102 and the second element 104 form a T handle in a different manner, for example, without the use of an aperture and a slot.

Figure 5:
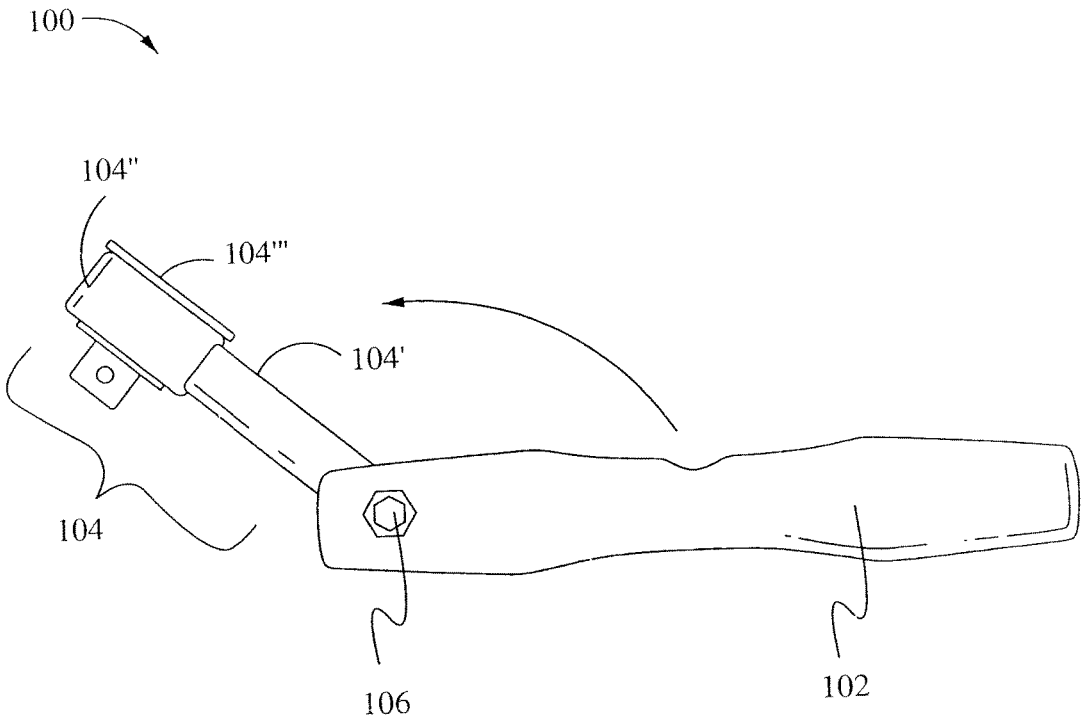
FIG. 5 illustrates a perspective view of the dual purpose flip-out and T handle folding out from the T position in accordance with an embodiment of the invention.

FIG. 5 illustrates a perspective view of the dual purpose flip-out and T handle 100 folding out from the T position. The second element 104 rotates around the hinge 106 in an outward motion to return to the straight configuration or an L/modified-L configuration.

Figure 6:
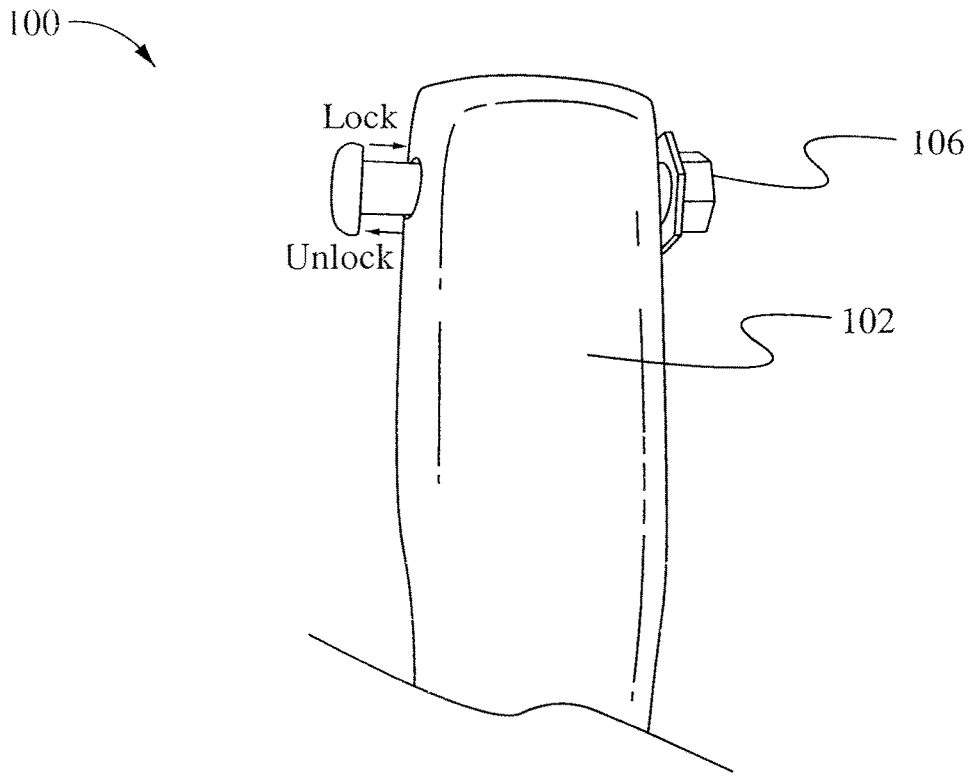
FIG. 6 illustrates a side view of the lockable hinge which is able to lock the handle in a desired configuration in accordance with an embodiment of the invention.

FIG. 6 illustrates a side view of the lockable hinge 106 which is able to lock the handle 100 in a desired configuration. In some embodiments, the lockable hinge 106 is a detent or a push/slide switch to lock the hinge 106. For example, if a user wants to lock the configuration of a 120° angle as shown in FIG. 2, the user is able to use the lockable hinge 106 to do so. The user is also able to lock the handle in the T configuration. To unlock the hinge 106, the user positions the lockable hinge 106 in an unlock position, such as by pushing the switch in the opposite direction.

Figure 7:
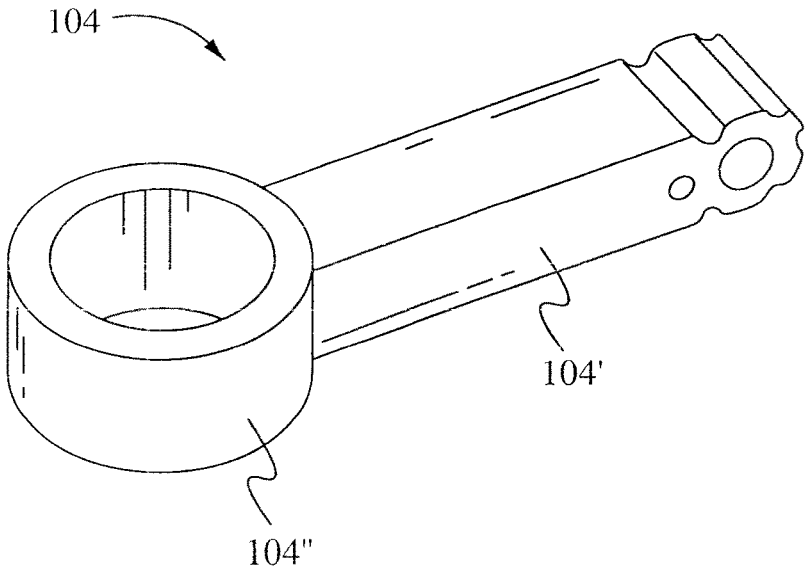
FIG. 7 illustrates a perspective view of a stem portion and head portion of a second element without a drive in the head portion in accordance with an embodiment of the invention.

FIG. 7 illustrates a perspective view of a stem portion 104' and head portion 104" of a second element 104 without a drive in the head portion 104". In some embodiments, the end of the stem portion 104' includes one or more apertures for receiving the hinge 106. In some embodiments, the end of the stem portion 104' includes ridges, grooves or another implementation to allow second element 104 to be configured at different positions such as 180°, 150°, 120° and 90°.

Figure 8A:
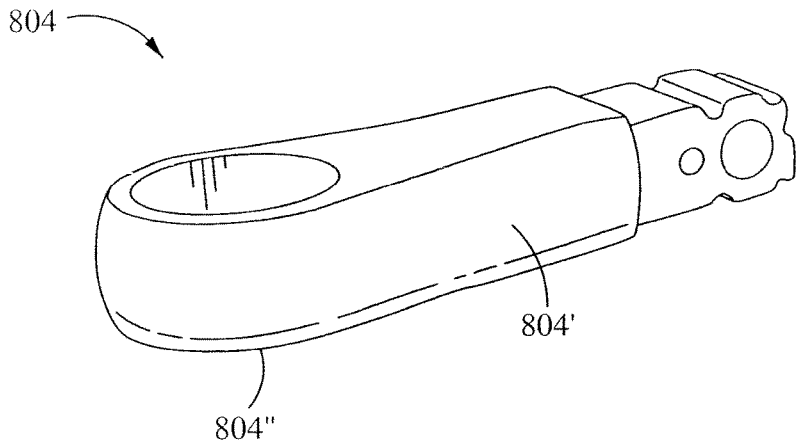
FIG. 8A illustrates a perspective view of a modified second element without a drive in accordance with an embodiment of the invention.

FIG. 8A illustrates a perspective view of a modified second element 804 without a drive. The modified second element 804 contains a stem portion 804' and a head portion 804". The stem portion 804' of the modified second element 804 includes a smoother transition to the head portion 804". Furthermore, the head portion 804" is more rounded.

Figure 8B:
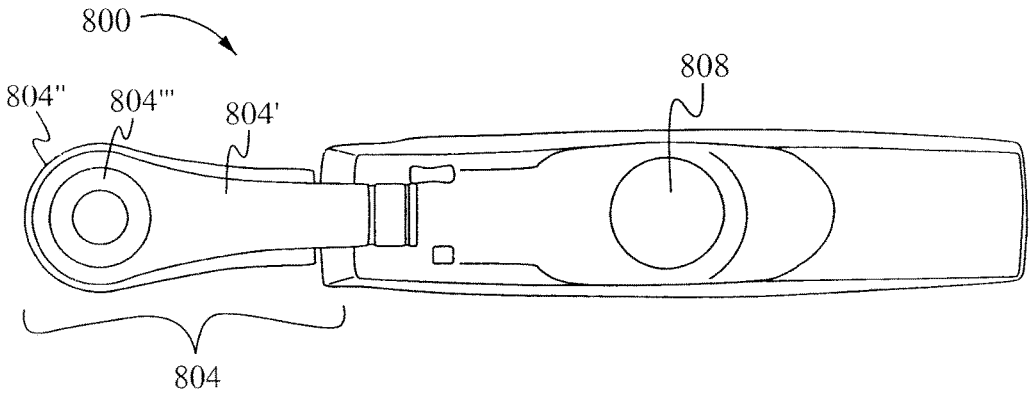
FIG. 8B illustrates a top view of a modified dual purpose flip-out and T handle in an open configuration in accordance with an embodiment of the invention.

FIG. 8B illustrates a top view of a modified dual purpose flip-out and T handle 800 in an open configuration. As described above, the modified second element 804 contains a stem portion 804' and a head portion 804". The stem portion 804' of the modified second element 804 includes a smoother transition to the head portion 804". Furthermore, the head portion 804" is more rounded. A handle portion 802 of the handle 800 includes an aperture 808 for receiving the head portion 804" of the modified second element 804. The handle portion 802 includes a receiving area (e.g. a depression) configured for receiving the stem portion 804'. A lockable hinge allows motion similar to the motion of the handle 100.

Figure 8C:
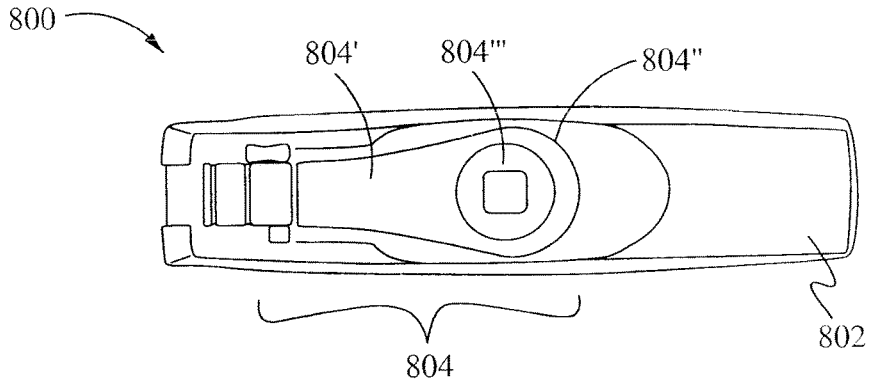
FIG. 8C illustrates a top view of a modified dual purpose flip-out and T handle in a closed or T configuration in accordance with an embodiment of the invention.

FIG. 8C illustrates a top view of a modified dual purpose flip-out and T handle 800 in a closed or T configuration. Similar to the handle 100, when configured appropriately, the handle 800 is able to form a T handle.

Figure 9:
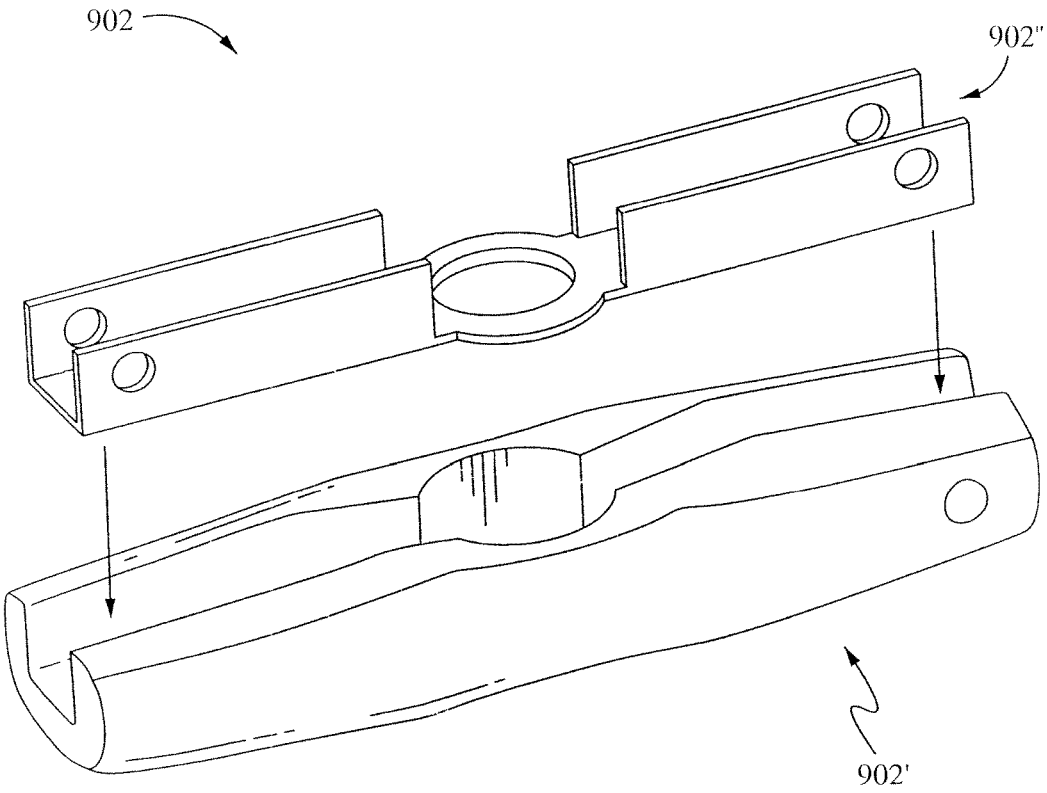
FIG. 9 illustrates a perspective view of a modified handle portion of the dual purpose flip-out and T handle in accordance with an embodiment of the invention.

FIG. 9 illustrates a perspective view of a modified handle portion 902 of the dual purpose flip-out and T handle. The handle portion 902 includes a bent steel substructure insert 902" which is inserted into an overmold 902'.

Figure 10:
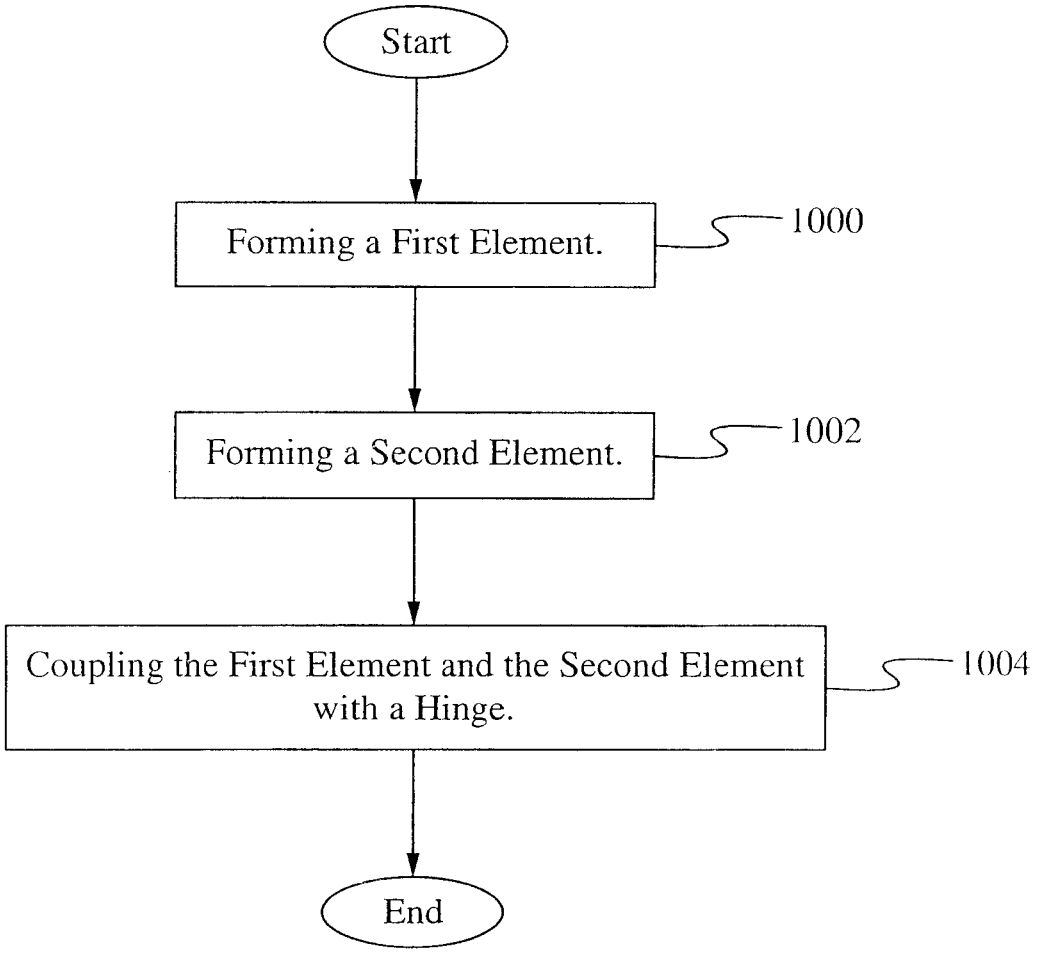
FIG. 10 illustrates a flowchart of a method of manufacturing the dual purpose flip-out and T handle in accordance with an embodiment of the invention.

FIG. 10 illustrates a flowchart of a method of manufacturing the dual purpose flip-out and T handle. In the step 1000, a first element is formed. In the step 1002, a second element is formed. In the step 1004, the first element and the second element are coupled with a hinge. The first element is configured to be hand-held and thus is sized accordingly. In some embodiments, the first element includes an aperture for receiving the head of the second element. In some embodiments, the first element includes a slot for receiving the stem of the second element. In some embodiments, the first element includes one or more holes for receiving the hinge. In some embodiments, the first element includes a receiving area for receiving the second element. In some embodiments, the first element is cast. In some embodiments, the first element is molded. In some embodiments, the first element includes a substructure insert which is inserted into an overmold. In some embodiments, the second element is one piece. In some embodiments, the second element is multiple pieces where the head section and stem section are separate components. In some embodiments, a drive is included within the head section. In some embodiments, a removable/replaceable drive is installed in the head. In some embodiments, the second element includes grooves, ridges or another implementation for aiding in locking into positions. In some embodiments, the order of the steps 1000 and 1002 is reversed or performed simultaneously. In some embodiments, the hinge is a lockable hinge.

The dual purpose flip-out and T handle is able to composed of any material. In some embodiments, the handle portion of the handle is a cast metal handle. In some embodiments, the handle is a durable plastic or rubber. In some embodiments, the handle is a combination of materials such as metal and rubber.

The dual purpose flip-out and T handle is able to be used with any type of device such as bolts, nuts, screws, and other devices with any type of drive type such as slotted, Phillips-head, hexagonal and others.

To utilize the dual purpose flip-out and T handle, a user initially configures the handle in a desired orientation. The user is able to configure the handle into an L, modified-L, T or modified-T configuration. Once in the desired orientation, the user is able to lock the handle into that configuration. The user uses the handle similarly to any other ratchet tool or T handle tool for tightening or loosening screws, nuts, bolts or other items.

In operation, the dual purpose flip-out and T handle, allows a user to reach items such as screws, nuts or bolts that are not able to be reached by standard tools. For example, if a screw is tucked away in a partially enclosed area, the handle is able to be modified into an L or a modified-L orientation to allow the user to reach the item with the handle and perform the desired task. Furthermore, the handle is able to be configured in a T handle orientation to provide a user with a better grip on the handle. The different configurations, L, modified-L, T and modified-T enable one handle to be able to used for many different tasks and reduces the number of tools required by a user.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A device comprising:

a. a first element comprising an aperture and including a channel having a first side with a channel bottom on a first side of the aperture and a second side with a channel bottom on a second side of the aperture, wherein the second side of the channel defines a free and open end away from the aperture; and b. a second element comprising:

i. a ratchet mechanism; and ii. an elongated neck coupled between the ratchet mechanism and the first element at a hinge;

wherein the second element is movable to a plurality of positions by movement around the hinge and further wherein the first side of the channel receives the elongated neck, the aperture receives the ratchet mechanism and the second side of the channel extends beyond the aperture and ratchet mechanism when the second element is configured in one of the plurality of positions.

2. The device of claim 1 wherein the hinge further comprises a locking mechanism configured for locking the second element into the plurality of positions.

3. The device of claim 1 wherein the plurality of positions include forming an L handle, a modified-L handle, a T handle and a modified-T handle.

4. The device of claim 3 wherein the modified-L handle forms an angle greater than 90° and less than 180° between the first element and the second element.

5. The device of claim 3 wherein the first element is configured to receive the second element when forming the T handle.

6. The device of claim 1 wherein the first element and the second element comprise rubber, plastic, metal or a combination thereof.

7. A device comprising:

a. a head and neck element including:

i. a head; and ii. a neck;

b. a handle element including:

i. a body;

ii. an aperture within the body, the aperture configured for receiving the head; and iii. a channel having a first side with a channel bottom on a first side of the aperture and a second side with a channel bottom on a second side of the aperture and positioned along the surface of one side of the body, the channel configured for receiving the neck, wherein the second side of the channel defines a free and open end away from the aperture;

c. a lockable hinge for coupling the head and neck element and the handle element, the lockable hinge configured for allowing the head and neck element to move into a plurality of positions and maintaining a position of the plurality of positions; and d. a ratchet mechanism contained within the head.

8. The device of claim 7 wherein the ratchet mechanism is removable.

9. The device of claim 7 wherein the plurality of positions include forming an L handle, a modified-L handle, a T handle and a modified-T handle.

10. The device of claim 9 wherein the modified-L handle forms an angle greater than 90° and less than 180° between the head and neck element and the handle element.

11. The device of claim 9 wherein the aperture is configured to receive the head when forming the T handle.

12. The device of claim 7 wherein the head and neck element and the handle element comprise rubber, plastic, metal or a combination thereof.

13. A method of manufacturing a device comprising:

a. forming a first element comprising an aperture and including a channel having a first side with a channel bottom on a first side of the aperture and a second side with a channel bottom on a second side of the aperture, wherein the second side of the channel defines a free and open end away from the aperture;

b. forming a second element containing a ratchet mechanism and a neck coupled to the ratchet mechanism, wherein the channel is configured for receiving the ratchet mechanism within the aperture and the neck within the first side of the channel and the second side of the channel extends beyond the aperture and the ratchet mechanism; and c. coupling the first element and the second element with a hinge, the second element configurable to a plurality of positions by movement around the hinge.

14. The method of claim 13 wherein the hinge is lockable.

15. The method of claim 13 wherein the plurality of positions include forming an L handle, a modified-L handle, a T handle and a modified-T handle.

16. The method of claim 15 wherein the modified-L handle forms an angle greater than 90° and less than 180° between the first element and the second element.

17. The method of claim 15 wherein the first element is configured to receive the second element when forming the T handle.

18. The method of claim 13 wherein the first element and the second element comprise rubber, plastic, metal or a combination thereof.

* * * * *